US008866578B2

(12) United States Patent
Yen

(10) Patent No.: US 8,866,578 B2
(45) Date of Patent: Oct. 21, 2014

(54) MAGNETIC ELEMENT AND BOBBIN THEREOF

(71) Applicant: Delta Electronics, Inc., Taoyuan Hsien (TW)

(72) Inventor: Cheng-Ching Yen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/906,869

(22) Filed: May 31, 2013

(65) Prior Publication Data

US 2014/0240073 A1 Aug. 28, 2014

(30) Foreign Application Priority Data

Feb. 27, 2013 (TW) ..... 102106806 A

(51) Int. Cl.
*H01F 27/30* (2006.01)

(52) U.S. Cl.
USPC ..... 336/198

(58) Field of Classification Search
USPC ..... 336/196, 198, 200, 232, 192
See application file for complete search history.

(56) References Cited

FOREIGN PATENT DOCUMENTS

| | | |
|---|---|---|
| JP | H0864411 | 3/1996 |
| JP | 2011222637 | 11/2011 |
| TW | M441919 | 11/2012 |

*Primary Examiner* — Tuyen Nguyen
(74) *Attorney, Agent, or Firm* — Kirton McConkie; Evan R. Witt

(57) ABSTRACT

A bobbin includes a first lateral plate, a second lateral plate, a winding section, a channel, a plurality of first pins and a plurality of second pins. A plurality of first protrusion structures are protruded externally from an edge of the second lateral plate. Each of the first protrusion structures includes an inner wall and a first notch. The inner walls of two adjacent first protrusion structures face each other and are separated from each other by a specified distance. The first notches of the first protrusion structures are respectively formed in the corresponding inner walls and staggered relative to each other. The first pins are disposed on the first protrusion structures, respectively. The second pins are disposed on the first protrusion structures, respectively. The first pins and the second pins are perpendicular to bottom surfaces of respective first protrusion structures.

9 Claims, 5 Drawing Sheets

MAGNETIC ELEMENT AND BOBBIN THEREOF

TECHNICAL FIELD

The present disclosure relates to a magnetic element and a bobbin, and more particularly to a magnetic element and a bobbin for use with an automatic winding machine.

DESCRIPTION OF THE RELATED ART

Magnetic elements are widely used in many electronic devices to generate induced magnetic fluxes. A transformer is a magnetic element that transfers electric energy from one circuit to another through coils in order to regulate the voltage to a desired range required for powering the electronic device.

Nowadays, for saving labor cost, shortening the process time and increasing the quality and yield of the product, the automatic method of fabricating the transformer is gradually adopted. By the automatic method, the manual labor is replaced by machines. Consequently, the labor cost is saved and the production performance is enhanced.

FIG. 1A is a schematic front view illustrating a conventional bobbin of a transformer, in which a primary winding coil is wound thereon. As shown in FIG. 1A, the conventional bobbin 1 includes a first lateral plate 10, a second lateral plate 11, a winding section 12, and a plurality of pins 13. The first lateral plate 10 and the second lateral plate 11 are opposite to each other. The winding section 12 is arranged between the first lateral plate 10 and the second lateral plate 11. A primary winding coil 14 is wound around the winding section 12. The pins 13 are externally and vertically protruded from the second lateral plate 11. The outlet terminals of the primary winding coil 14 may be wound around and fixed on the pins 13.

Please refer to FIG. 1A again. The primary winding coil 14 includes a first outlet terminal 141 and a second outlet terminal 142. The first outlet terminal 141 and the second outlet terminal 142 are wound around and fixed on a first pin 131 and a second pin 132 of the pins 13, respectively. Namely, for performing a winding task by an automatic winding machine, the second outlet terminal 142 of the primary winding coil 14 is firstly wound around and fixed on the second pin 132, then the primary winding coil 14 is wound around the winding section 12, and finally the first outlet terminal 141 of the primary winding coil 14 is wound around and fixed on the first pin 131. However, since the winding task is performed by the automatic winding machine along a linear direction only, some drawbacks may occur. For example, as shown in FIG. 1A, after the second outlet terminal 142 of the primary winding coil 14 is wound around and fixed on the second pin 132 and the primary winding coil 14 is wound around the winding section 12, the first outlet terminal 141 of the primary winding coil 14 is drawn by the automatic winding machine along a linear direction and further wound around and fixed on the first pin 131. After the winding task is completed, a part of the first outlet terminal 141 and a part of the second outlet terminal 142 are overlapped with each other. Consequently, a short-circuited problem may occur. For solving this problem, the first outlet terminal 141 and the second outlet terminal 142 of the primary winding coil 14 may be covered with tubes or tapes (not shown). Due to the tubes or tapes, the first outlet terminal 141 and the second outlet terminal 142 of the primary winding coil 14 are effectively isolated from each other. However, the steps of covering the first outlet terminal 141 and the second outlet terminal 142 with tubes or tapes are labor-intensive and time-consuming and increase the material cost. Moreover, the winding task is not completely automatic.

FIG. 1B is a schematic partial perspective view illustrating the conventional bobbin of the transformer after the winding task is completed. As shown in FIG. 1B, the second lateral plate 11 of the conventional bobbin 1 further includes a plurality of extension parts 111 and a plurality of wire-managing grooves 112. The extension parts 111 are horizontally extended from an edge of the second lateral plate 11. A plurality of pins 13 are disposed on the extension parts 111. Each wire-managing groove 112 is arranged between every two adjacent extension parts 111 for accommodating the outlet terminal of the primary winding coil 14.

Moreover, the outermost extension part 111 of the bobbin 1 further includes a wire-managing notch 113. For managing the outlet terminal of the primary winding coil 14, one outlet terminal of the primary winding coil 14 may be manually received within the wire-managing notch 113, and then wound around and fixed on the corresponding pin. However, for meeting the automatic production requirements, the winding task should be performed by the automatic winding machine in a completely automatic manner. Since the winding task is performed by the automatic winding machine along the linear direction only, the outlet terminal of the primary winding coil 14 is readily detached from the wire-managing notch 113 after the winding task is done. After the winding task of the bobbin 1 is completed, for combining a magnetic core assembly (not shown) with the bobbin 1, the portion of the outlet terminal of the primary winding coil 14 which is detached from the wire-managing notch 113 may hinder the process of assembling the magnetic core assembly with the bobbin 1. If the magnetic core assembly and the bobbin 1 are combined together reluctantly, the outlet terminal of the primary winding coil 14 may be broken. Under this circumstance, the safety of the transformer is impaired, and the transformer fails to be normally operated.

BRIEF SUMMARY

The present disclosure provides a magnetic element and a bobbin for use with an automatic winding machine in order to minimize the possibility of overlapping or detaching the outlet terminals of the winding coils during the process of performing the winding task by the automatic winding machine. Consequently, the process of assembling the magnetic core assembly with the bobbin is not hindered by the detached outlet terminals of the winding coils.

The present disclosure also provides a magnetic element and a bobbin for use with an automatic winding machine in order to perform the winding task in a completely automatic manner, save the labor cost, improve the process quality and enhance the product reliability.

In accordance with an aspect of the present disclosure, there is provided a bobbin of a magnetic element. The bobbin includes a first lateral plate, a second lateral plate, a winding section, a channel, a plurality of first pins and a plurality of second pins. The second lateral plate is opposite to the first lateral plate. A plurality of first protrusion structures are protruded externally from an edge of the second lateral plate. Each of the first protrusion structures includes an inner wall and a first notch. The inner walls of two first protrusion structures face each other and are separated from each other by a specified distance. The first notches of the first protrusion structures are respectively formed in the corresponding inner walls and staggered relative to each other. The winding section is arranged between the first lateral plate and the second lateral plate. The channel runs through the first lateral plate, the winding section and the second lateral plate. The first pins are disposed on the first protrusion structures, respectively.

The second pins are disposed on the first protrusion structures, respectively. The first pins and the second pins are perpendicular to bottom surfaces of respective first protrusion structures, and the bottom surfaces are perpendicular to the inner walls.

In accordance with another aspect of the present disclosure, there is provided a magnetic element. The magnetic element includes a winding coil assembly, a bobbin, and a magnetic core assembly. The winding coil assembly includes at least one primary winding coil and a secondary winding coil. The at least one primary winding coil includes a plurality of outlet terminals. The bobbin includes a first lateral plate, a second lateral plate, a winding section, a channel, a plurality of first pins and a plurality of second pins. The second lateral plate is opposite to the first lateral plate. A plurality of first protrusion structures are protruded externally from an edge of the second lateral plate. Each of the first protrusion structures includes an inner wall and a first notch. The inner walls of two first protrusion structures face each other and are separated from each other by a specified distance. The first notches of the first protrusion structures are respectively formed in the corresponding inner walls and staggered relative to each other. The winding section is arranged between the first lateral plate and the second lateral plate. The channel runs through the first lateral plate, the winding section and the second lateral plate. The first pins are disposed on the first protrusion structures, respectively. The second pins are disposed on the first protrusion structures, respectively. The first pins and the second pins are perpendicular to bottom surfaces of respective first protrusion structures, and the bottom surfaces are perpendicular to the inner walls. The magnetic core assembly is partially embedded into the channel of the bobbin.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
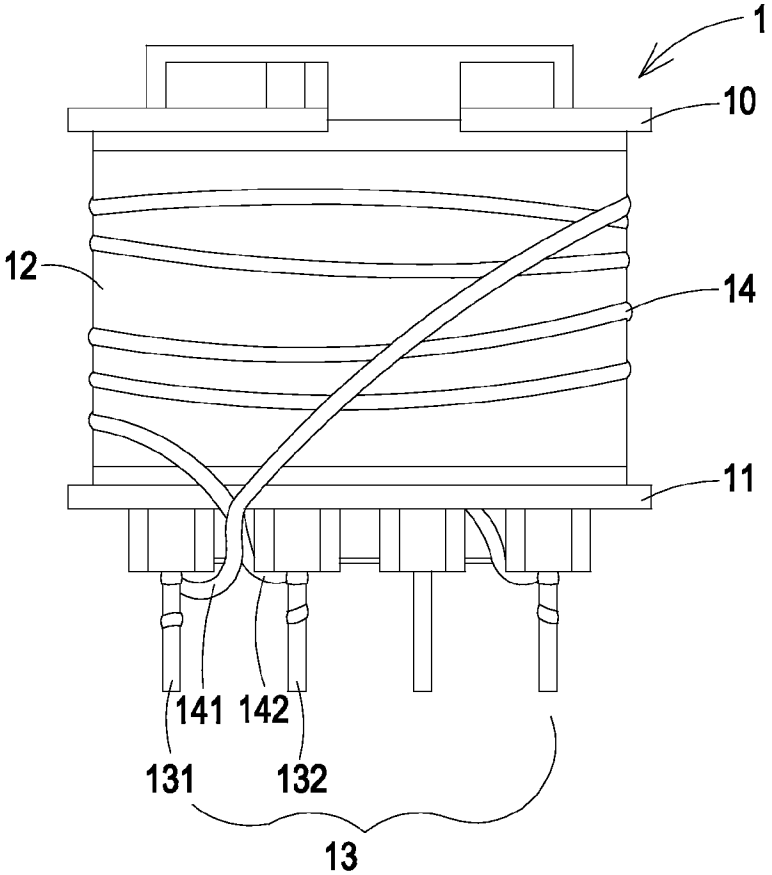
FIG. 1A (PRIOR ART)
FIG. 1A is a schematic front view illustrating a conventional bobbin of a transformer, in which a primary winding coil is wound thereon.
Figure 1B:
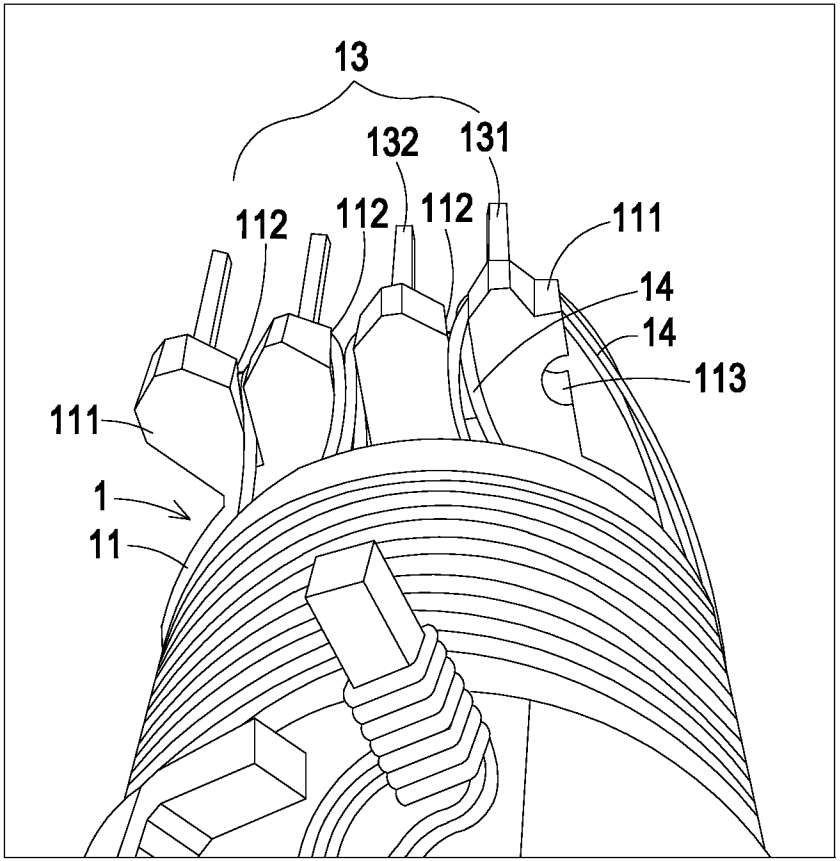
FIG. 1B (PRIOR ART)
FIG. 1B is a schematic partial perspective view illustrating the conventional bobbin of the transformer after the winding task is completed.
Figure 2:
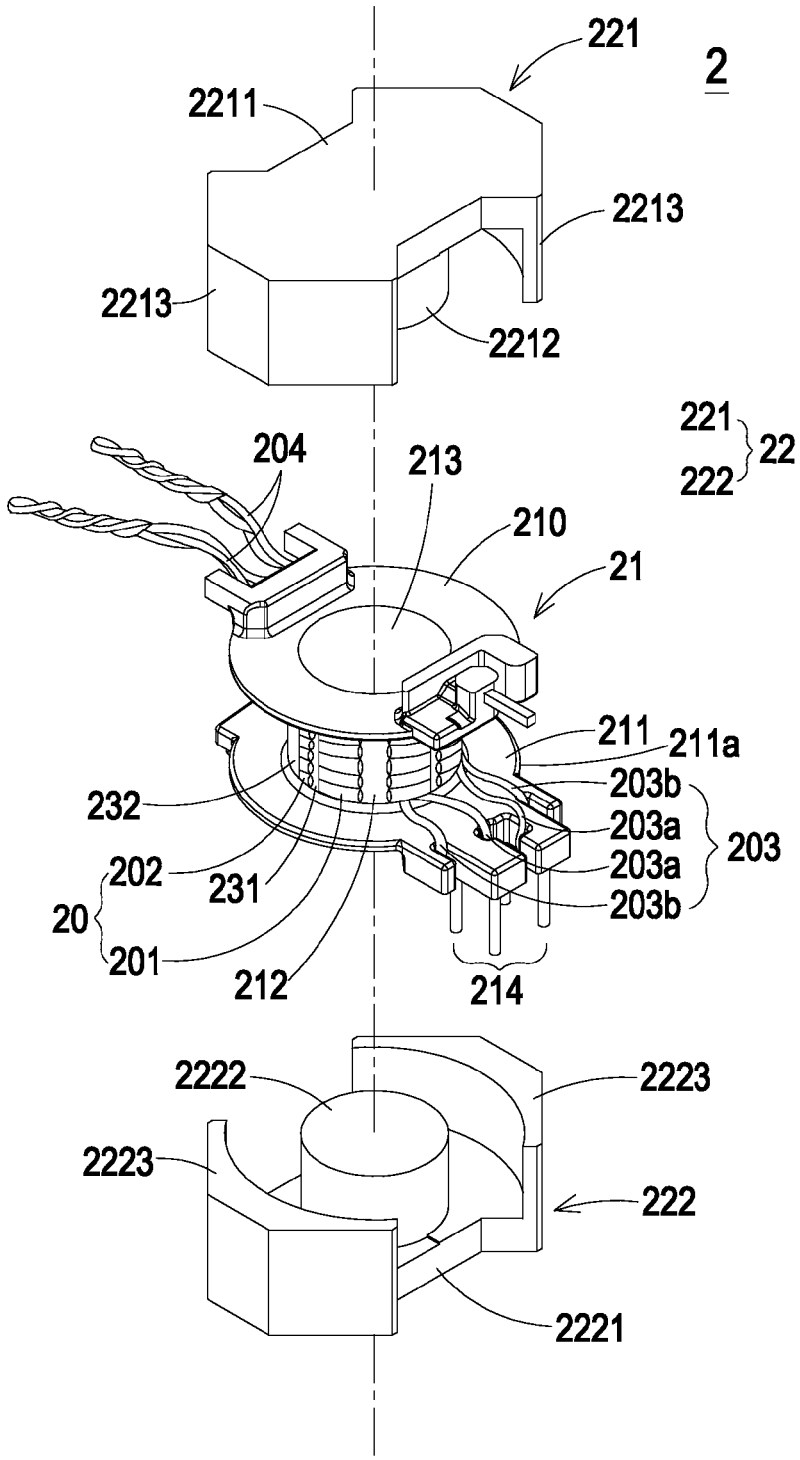
FIG. 2 is a schematic exploded view illustrating a magnetic element according to an embodiment of the present disclosure.

FIG. 2 is a schematic exploded view illustrating a magnetic element according to an embodiment of the present disclosure. An example of the magnetic element 2 includes but is not limited to a transformer or an inductor. In the embodiment as shown in FIG. 2, the magnetic element 2 is a transformer. As shown in FIG. 2, the magnetic element 2 comprises a winding coil assembly 20, a bobbin 21, and a magnetic core assembly 22. The winding coil assembly 20 comprises at least one primary winding coil 201 and a secondary winding coil 202. The bobbin 21 is used for winding the primary winding coil 201 and the secondary winding coil 202 thereon. The primary winding coil 201 and the secondary winding coil 202 are insulated from each other. Moreover, the primary winding coil 201 and the secondary winding coil 202 are wound around the bobbin 21 and stacked on each other. The magnetic core assembly 22 is partially embedded into the bobbin 21. After the magnetic core assembly 22 and the bobbin 21 with the winding coil assembly 20 are combined together, the magnetic element 2 is assembled.

Please refer to FIG. 2 again. The bobbin 21 comprises a first lateral plate 210, a second lateral plate 211, a winding section 212, and a channel 213. The first lateral plate 210 and the second lateral plate 211 are opposite to each other. The winding section 212 is arranged between the first lateral plate 210 and the second lateral plate 211. The primary winding coil 201 and the secondary winding coil 202 are wound around the winding section 212. The channel 213 runs through the first lateral plate 210, the winding section 212 and the second lateral plate 211 for partially accommodating the magnetic core assembly 22. It is preferred that the bobbin 21 is integrally formed. In addition, the primary winding coil 201 and the secondary winding coil 202 are conductive wires sheathed by insulating layers. When the primary winding coil 201 and the secondary winding coil 202 are wound on the winding section 212 of the bobbin 22, the primary winding coil 201 and the secondary winding coil 202 may be separated from each other through a first insulating medium 231 (e.g. an insulating tape). Furthermore, a second insulating medium 232 is optionally wound around the outer periphery of the secondary winding coil 202 in order to enhance the isolating efficacy. For clearly illustrating the relationships among the primary winding coil 201, the first insulating medium 231, the secondary winding coil 202 and the second insulating medium 232, these components as shown in FIG. 2 are partially cut away. In practice, these components are continuously wound around the winding section 212.

In addition, the primary winding coil 201 comprises a plurality of outlet terminals 203, and the secondary winding coil 202 comprises a plurality of outlet terminals 204. The outlet terminals 203 of the primary winding coil 201 and the outlet terminals 204 of the secondary winding coil 202 are protruded out of the winding section 212 of the bobbin 21 in the opposite directions. The outlet terminals 203 of the primary winding coil 201 are wound around and fixed on corresponding pins 214. The outlet terminals 204 of the secondary winding coil 202 are coated with tin solders and further electrically connected with a circuit board (not shown).

The magnetic core assembly 22 of the magnetic element 2 comprises a first magnetic core 221 and a second magnetic core 222. In this embodiment, the first magnetic core 221 and the second magnetic core 222 are collectively defined as an EE-shaped magnetic core assembly, but it is not limited thereto. The first magnetic core 221 comprises a connecting part 2211, a middle post 2212 and two lateral posts 2213. The second magnetic core 222 comprises a connecting part 2221, a middle post 2222 and two lateral posts 2223. The two lateral posts 2213 are vertically extended from two opposite edges of the connecting part 2211, respectively. The middle post 2212 is vertically extended from a center portion of the connecting part 2211 and arranged between the two lateral posts 2213. The two lateral posts 2223 are vertically extended from two opposite edges of the connecting part 2221, respectively. The middle post 2222 is vertically extended from a center portion of the connecting part 2221 and arranged between the two lateral posts 2223. For combining the first magnetic core 221, the second magnetic core 222 and the bobbin 21 together, the middle post 2212 of the first magnetic core 221 and the middle post 2222 of the second magnetic core 222 are partially received within the channel 213 of the bobbin 21. At the same time, the connecting part 2211 of the first magnetic core 221 and the connecting part 2221 of the second magnetic core 222 are respectively attached on the first lateral plate 210 and the second lateral plate 211, and the winding coil assembly 20 and the bobbin 21 are partially enclosed by the two lateral posts 2213 of the first magnetic core 221 and the two lateral posts 2223 of the second magnetic core 222. In some embodiments, the first magnetic core 221 and the second magnetic core 222 are connected with each other via adhesive (not shown), so that the winding coil assembly 20 and the bobbin 21 are securely fixed between the first magnetic core 221 and the second magnetic core 222. Meanwhile, the magnetic element 2 is assembled.

Figure 3A:
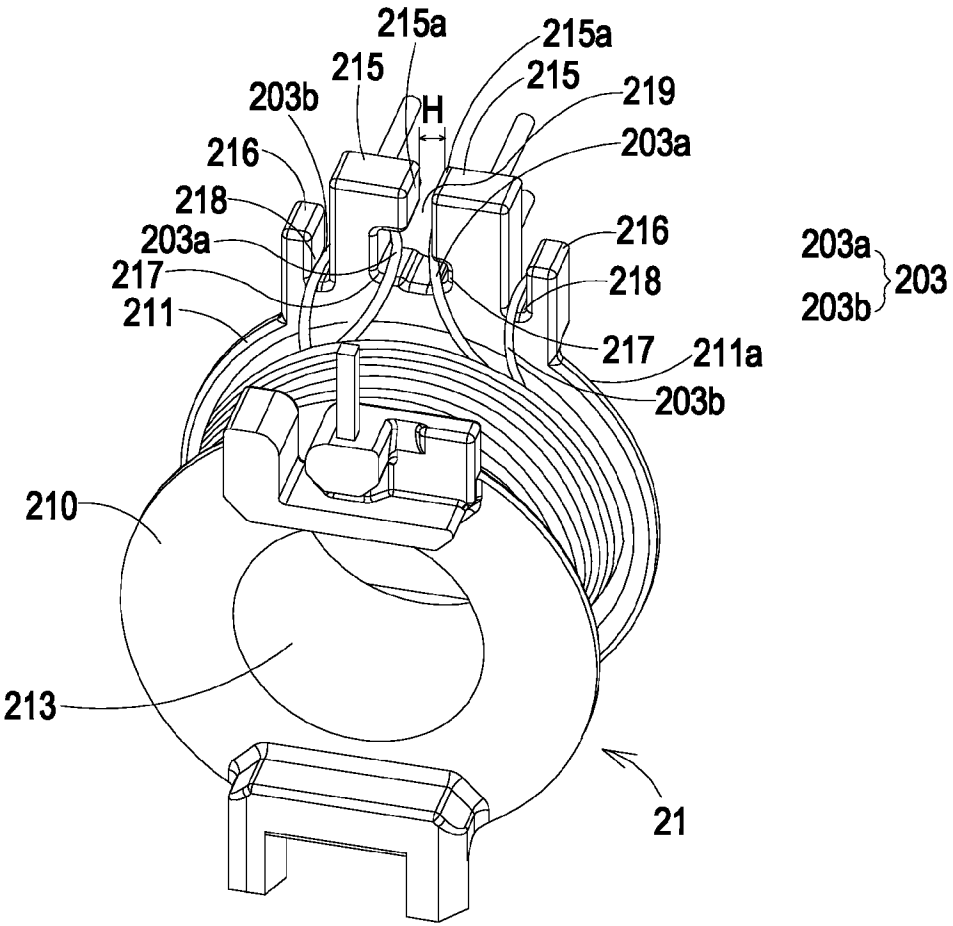
FIG. 3A is a schematic perspective view illustrating the combination of the bobbin and the winding coil assembly of the magnetic element of FIG. 2.
Figure 3B:
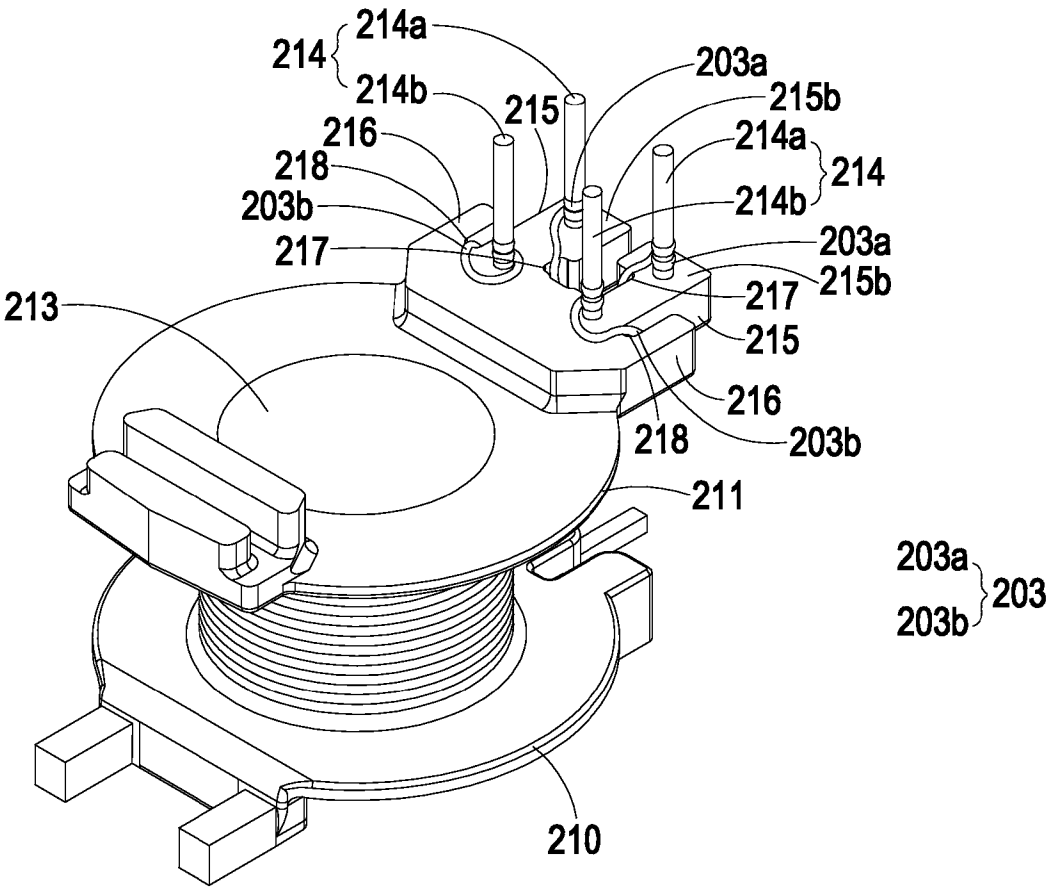
FIG. 3B is a schematic perspective view illustrating the combination of the bobbin and the winding coil assembly of the magnetic element of FIG. 3A and taken along another viewpoint.

FIG. 3A is a schematic perspective view illustrating the combination of the bobbin and the winding coil assembly of the magnetic element of FIG. 2. FIG. 3B is a schematic perspective view illustrating the combination of the bobbin and the winding coil assembly of the magnetic element of FIG. 3A and taken along another viewpoint. As shown in FIG. 3A, the second lateral plate 211 of the bobbin 21 comprises a plurality of first protrusion structures 215 and a plurality of second protrusion structures 216. Preferably, the second lateral plate 211 of the bobbin 21 comprises two first protrusion structures 215 and two second protrusion structures 216. In this embodiment, the two first protrusion structures 215 and the two second protrusion structures 216 are protruded externally from an edge 211*a* of the second lateral plate 211. It is noted that the number of the first protrusion structures 215 and the number of the second protrusion structures 216 may be varied according to the practical requirements. The two first protrusion structures 215 are located adjacent to each other. Consequently, a passageway 219 is defined by the two first protrusion structures 215. The two second protrusion structures 216 are located at bilateral sides of the two first protrusion structures 215. Each of the first protrusion structures 215 has a protrusion length longer than that of the second protrusion structure 216. In some embodiments, the winding coil assembly 20 comprises a plurality of primary winding coils 201 and a secondary winding coil 202, but it is not limited thereto. The outlet terminals 203 of the primary winding coils 201 may be divided into a plurality of first outlet parts 203*a* and a plurality of second outlet parts 203*b*. Each of the first protrusion structures 215 comprises an inner wall 215*a* and a first notch 217. The first notch 217 is formed in the inner wall 215*a*. The inner walls 215*a* of the two first protrusion structures 215 face each other. Moreover, the inner walls 215*a* of the two first protrusion structures 215 are separated from each other by a specified distance H. The first outlet parts 203*a* of the primary winding coils 201 may be received within the two first notches 217 of the two first protrusion structures 215. In some embodiments, the two first notches 217 of the two first protrusion structures 215 are staggered. Consequently, after the first outlet parts 203*a* of the primary winding coils 201 are received within the two first notches 217, the first outlet parts 203*a* are not in direct contact with each other. Since the first outlet parts 203*a* of the primary winding coils 201 are not overlapped with each other, the possibility of causing the short-circuited problem of the magnetic element 2 during the process of performing the winding task will be minimized.

On the other hand, the bobbin 21 further comprises a plurality of second notches 218. The second notches 218 are arranged between the first protrusion structures 215 and the adjacent second protrusion structures 216. The second outlet parts 203*b* of the primary winding coils 201 may be received within the second notches 218. After the first outlet parts 203*a* and the second outlet parts 203*b* of the primary winding coils 201 are respectively received within the first notches 217 and the second notches 218, the outlet terminals 203 of the primary winding coils 201 are wound around and fixed on corresponding pins 214. Since the outlet terminals 203 of the primary winding coils 201 are effectively managed and concentrated, the possibility of detaching the outlet terminals 203 of the primary winding coils 201 during the process of performing the winding task by the automatic winding machine along the linear direction will be minimized. Under this circumstance, the process of assembling the magnetic core assembly 22 with the bobbin 21 is not hindered by the detached outlet terminals 203.

Please refer to FIG. 3B again. The pins 214 of the bobbin 21 comprise two first pins 214*a* and two second pins 214*b*. The two first pins 214*a* are disposed on the two first protrusion structures 215, respectively. In addition, the two second pins 214*b* are disposed on the two first protrusion structures 215, respectively. In particular, the two first pins 214*a* and the two second pins 214*b* are perpendicular to the bottom surfaces 215*b* of respective first protrusion structures 215, wherein the bottom surfaces 215*b* of the first protrusion structures 215 are perpendicular to the inner walls 215*a*. In this embodiment, the first pins 214*a* and the corresponding second pins 214*b* are in a tandem arrangement. In some embodiments, the first pins 214*a* are arranged in front of the second pins 214*b*. In addition, one first pin 214*a* and one second pin 214*b* are disposed on the corresponding first protrusion structure 215 in the tandem arrangement. It is noted that the number of the first pins 214*a* and the number of the second pins 214*b* may be varied according to the practical requirements. Since the first pins 214*a* and the corresponding second pins 214*b* are in the tandem arrangement, the outlet terminals 203 of the primary winding coils 201 can be effectively managed and concentrated. Under this circumstance, the possibility of detaching or overlapping the outlet terminals 203 of the primary winding coils 201 during the process of performing the winding task by the automatic winding machine along the linear direction will be minimized.

Please refer to FIGS. 3A and 3B again. After the first outlet parts 203*a* of the primary winding coils 201 are received within the two first notches 217, the first outlet parts 203*a* are wound around and fixed on the corresponding first pins 214*a*. Similarly, after the second outlet parts 203*b* of the primary winding coils 201 are received within the second notches 218, the second outlet parts 203*b* are wound around and fixed on the corresponding second pins 214*b*. It is noted that the way of winding the outlet terminals 203 of the primary winding coils 201 may be varied according to the practical requirements. Due to the first notches 217 and the second notches 218, the first outlet parts 203*a* and the second outlet parts 203*b* of the primary winding coils 201 are not overlapped with each other. Consequently, the possibility of causing the short-circuited problem of the magnetic element 2 will be minimized. Moreover, since the first pins 214*a* and the corresponding second pins 214*b* are in the tandem arrangement, the outlet terminals 203 of the primary winding coils 201 can be effectively managed and concentrated. Under this circumstance, the possibility of detaching the outlet terminals 203 of the primary winding coils 201 during the process of performing the winding task will be minimized. Since the process of assembling the magnetic core assembly 22 with the bobbin 21 is not hindered by the detached outlet terminals, the yield of fabricating the magnetic element 2 is enhanced.

From the above descriptions, the present disclosure provides a bobbin and a magnetic element with the bobbin. The bobbin may be applied to an automatic winding machine. The second lateral plate of the bobbin comprises a plurality of first protrusion structures and a plurality of second protrusion structures. Moreover, a plurality of first notches are formed in the first protrusion structures in a staggered configuration. After first outlet parts of the primary winding coils are respectively received within the first notches, the first outlet parts are wound around and fixed on corresponding pins. Since these first notches are in a staggered configuration, the first outlet parts of the primary winding coils which are located at the first protrusion structures are not in direct contact with each other. Since the first outlet parts of the primary winding coils are not overlapped with each other, the possibility of causing the short-circuited problem of the magnetic element by using the automatic winding machine to perform the winding task will be minimized. Moreover, the bobbin of the present disclosure further comprises a plurality of second notches. The second notches are arranged between the first protrusion structures and the adjacent second protrusion structures. The second outlet parts of the primary winding coils may be received within the second notches. Consequently, the possibility of detaching the outlet terminals of the primary winding coils during the process of performing the winding task by the automatic winding machine along the linear direction will be minimized. Under this circumstance, the process of assembling the magnetic core assembly with the bobbin can be effectively performed. On the other hand, since a plurality of first pins and a plurality of second pins are disposed on the bottom surfaces of the corresponding first protrusion structures of the second lateral plate of the bobbin in the tandem arrangement, the outlet terminals of the primary winding coils can be effectively managed and concentrated. Under this circumstance, the possibility of detaching or overlapping the outlet terminals of the primary winding coils will be minimized and the winding task can be performed by the automatic winding machine in a completely automatic manner. In other words, when the bobbin is used in an automatic winding machine to perform the winding task, the labor cost is saved, the process quality is improved and the product reliability is enhanced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bobbin of a magnetic element, said bobbin comprising:

a first lateral plate;

a second lateral plate opposite to said first lateral plate, wherein a plurality of first protrusion structures are protruded externally from an edge of said second lateral plate, and each of said first protrusion structures comprises an inner wall and a first notch, wherein said inner walls of two said first protrusion structures face each other and are separated from each other by a specified distance, wherein said first notches of said two first protrusion structures are respectively formed in corresponding said inner walls and staggered relative to each other;

a winding section arranged between said first lateral plate and said second lateral plate for winding at least one winding coil thereon;

a channel running through said first lateral plate, said winding section and said second lateral plate;

a plurality of first pins disposed on said first protrusion structures, respectively; and a plurality of second pins disposed on said first protrusion structures, respectively, wherein said first pins and said second pins are perpendicular to bottom surfaces of respective said first protrusion structures, said bottom surfaces are perpendicular to said inner walls, and a plurality of outlet terminals of said at least one winding coil are received within said first notches and fixed on corresponding said first pins.

2. The bobbin according to claim 1, further comprising a plurality of second protrusion structures, wherein said second protrusion structures are protruded externally from said edge of said second lateral plate and located at bilateral sides of said first protrusion structures, wherein each of said first protrusion structure has a protrusion length longer than that of said second protrusion structure.

3. The bobbin according to claim 2, further comprising a plurality of second notches, wherein said second notches are arranged between said first protrusion structures and said second protrusion structures.

4. The bobbin according to claim 1, wherein said first pins and corresponding said second pins are in a tandem arrangement.

5. A magnetic element, comprising:

a winding coil assembly comprising at least one primary winding coil and a secondary winding coil, wherein said at least one primary winding coil comprises a plurality of outlet terminals;

a bobbin comprising:

a first lateral plate;

a second lateral plate opposite to said first lateral plate, wherein a plurality of first protrusion structures are protruded externally from an edge of said second lateral plate, and each of said first protrusion structures comprises an inner wall and a first notch, wherein said inner walls of two said first protrusion structures face each other and are separated from each other by a specified distance, wherein said first notches of said two first protrusion structures are respectively formed in corresponding said inner walls and staggered relative to each other;

a winding section arranged between said first lateral plate and said second lateral plate;

a channel running through said first lateral plate, said winding section and said second lateral plate;

a plurality of first pins disposed on said first protrusion structures, respectively; and a plurality of second pins disposed on said first protrusion structures, respectively, wherein said first pins and said second pins are perpendicular to bottom surfaces of respective said first protrusion structures, said bottom surfaces are perpendicular to said inner walls, and said plurality of outlet terminals of said at least one primary winding coil are received within said first notches and fixed on corresponding said first pins; and a magnetic core assembly partially embedded into said channel of said bobbin.

6. The magnetic element according to claim 5, wherein said bobbin further comprises a plurality of second protrusion structures, wherein said second protrusion structures are protruded externally from said edge of said second lateral plate and located at bilateral sides of said first protrusion structures, wherein each of said first protrusion structure has a protrusion length longer than that of said second protrusion structure.

7. The magnetic element according to claim 6, wherein said bobbin further comprises a plurality of second notches, wherein said second notches are arranged between said first protrusion structures and said second protrusion structures.

8. The magnetic element according to claim 7, wherein said winding coil assembly comprises a plurality of primary winding coils comprising a plurality of said outlet terminals, wherein said outlet terminals of said primary winding coils are divided into a plurality of first outlet parts and a plurality of second outlet parts, wherein said first outlet parts are received within corresponding said first notches of said first protrusion structures and fixed on corresponding said first pins, wherein said second outlet parts are received within corresponding said second notches and fixed on corresponding said second pins.

9. The magnetic element according to claim 5, wherein said first pins and corresponding said second pins are in a tandem arrangement.

* * * * *